United States Patent [19]

Halula

[11] 4,264,063

[45] Apr. 28, 1981

[54] JOIST HANGER AID

[76] Inventor: Paul R. Halula, 1540 Lockhart Gulch Rd., Scotts Valley, Calif. 95066

[21] Appl. No.: 117,888

[22] Filed: Feb. 1, 1980

[51] Int. Cl.[3] ..... B25B 5/14

[52] U.S. Cl. ..... 269/41; 269/98; 269/133; 269/904

[58] Field of Search ..... 52/702; 248/215; 269/254 R, 321 S, 37, 40, 98, 41, 133

[56] References Cited

U.S. PATENT DOCUMENTS

| | | | |
|---|---|---|---|
| 3,420,560 | 1/1969 | Pfahning | 52/702 X |
| 3,759,505 | 9/1973 | Callanan | 269/254 R X |

FOREIGN PATENT DOCUMENTS

| | | | |
|---|---|---|---|
| 830832 | 2/1952 | Fed. Rep. of Germany | 52/702 |
| 1007078 | 4/1952 | France | 52/702 |

*Primary Examiner*—Robert C. Watson
*Attorney, Agent, or Firm*—Townsend and Townsend

[57] ABSTRACT

Disclosed is a reusable device for assisting a carpenter by securely holding up one end of a joist while the carpenter nails the other end in place. A pair of vertical supports has a pair of legs extending out and away from the respective lower ends of the supports. The outer ends of the legs are connected by a joist support stirrup. Generally horizontal arms extend from the upper ends of the vertical supports. The outer portions of the arms are bent into generally U-shaped configurations so that their free ends oppose their respective vertical supports. The distance between the free ends of the arms and their respective supports is such as to snugly hold a standard beam inserted therebetween, thus ensuring that the joist hanger and the supported joist therewith do not shift laterally. Further, the device can be used to hold a facing board against the end of a joist.

8 Claims, 2 Drawing Figures

JOIST HANGER AID

This invention relates to joist hangers, particularly to one which is reusable and keeps the supported joist from shifting.

BACKGROUND OF THE INVENTION

When building a structure, such as a house, the carpenter often finds it necessary to nail one end of a joist in place without having anyone around to hold up the other end. This is especially true of individuals who are building or making an addition to their own house.

There have been a number of joist hangers developed, for example those disclosed in U.S. Pat. Nos. 247,050; 783,807; and 1,728,613. These prior art devices, in addition to temporarily holding up the free end of a joist while the other end is nailed into place, are generally intended to act as permanent joist supports. To keep the joist from shifting, the hangers, often made of flat metal strips, are typically nailed to the beam. Such nailing is both times consuming and reduces, and sometimes eliminates, the ability to reuse the joist hanger. Although the prior art devices have had certain shortcomings, their use in the construction industry has been widespread, but primarily as permanently installed joist supports.

SUMMARY OF THE INVENTION

The present invention provides a substantial improvement over existing joist hangers by providing a joist hanger aid which is reusable and which allows the joist to be quickly and securely fixed in place without the use of nails, screws or other fastening devices.

The joist hanger aid of the present invention has a pair of elongate, vertical supports. A pair of legs extend at an angle out and away from the lower ends of the supports. The outer ends of the legs are connected by a joist support stirrup. The distance between the legs is such that a standard joist may be placed edgewise therebetween. A horizontal arm is attached to and extends from the respective upper ends of each elongate vertical support. The outer portion of each of the arms is bent into a generally U-shaped configuration so that the free ends of the arms are in a spaced, opposed relation with their respective vertical supports from which they extend. The distance between the free ends of the arms and their respective supports is typically equal to or slightly less than the width of the beam which will be inserted therebetween. The entire device is typically manufactured from a single length of relatively stiff wire. The resulting joist hanger aid is quickly and securely fastened to a beam by inserting the beam between respective free ends and vertical supports. The beam is thus captured between the free ends and the vertical supports ensuring that the joist hanger and the supported joist therewith do not inadvertently shift out of position. Further, the device can also be used to hold a facing board in place. The user merely turns the device upside down of its standard attitude and places the support member over the end of the supporting joist and secures the facing board between respective free ends and vertical supports.

The present invention provides a joist hanger which not only supports the end of the joist next to a beam but also ensures that the end of the joist does not shift laterally along the beam. The joist hanger is fastened to the beam without use of nails, screws or other fastening devices and thus can be quickly mounted to the beam. Further, the invention is intended to be reusable, thus lowering the cost to the user of the completed structure.

The joist hanger of the present invention can also be used to support a facing board to the end of the joist. In this case the facing board is securely held between the free ends of the recurved outer portions of the horizontal arms and the vertical supports. Thus an easily manufactured, reusable joist hanger aid serves both as a joist hanger and as a support for facing boards.

Additional features and advantages of the invention will appear from the following description in which the preferred embodiment has been set forth n detail in conjunction with the accompanying drawings

DESCRIPTION OF THE PREFERRED EMBODIMENT

Figure 1:
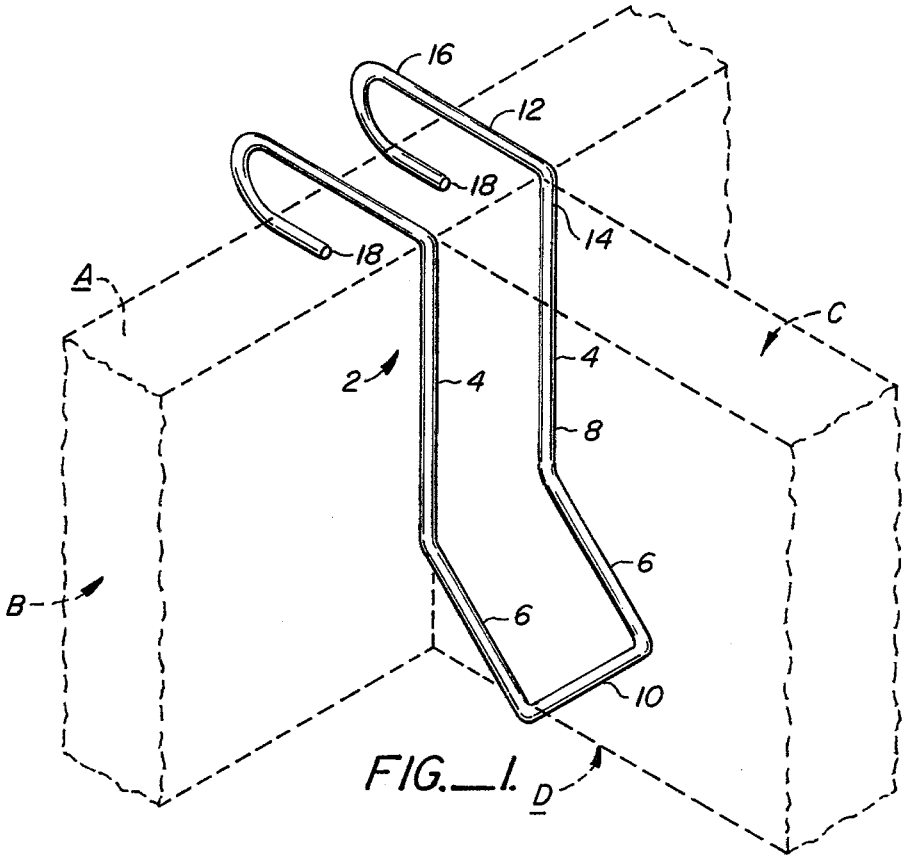
FIG. 1 is a perspective view of the preferred embodiment of the invention shown supporting a joist and mounted to a beam.

The preferred embodiment of the joist hanger aid shown in FIG. 1 has a pair of elongate vertical supports 4, a pair of parallel legs 6 extending at an angle from the lower ends 8 of the supports, a joist support stirrup 10 connecting the outer ends of legs 6, a pair of parallel horizontally extending arms 12 extending from the respective upper ends 14 of the supports. The outer portions 16 of each arm 12 are bent into U-shaped configurations so that the free ends 18 of the outer portions 16 face the vertically extending supports. Beam B and joist C are shown by dotted lines.

In the preferred embodiment, joist hanger aid 2 is formed from a length of relatively stiff, resilient metal wire, or thin metal rod, bent into the proper configuration. The use of a resilient material allows the joist hanger aid to be reused. A pair of spaced-apart, vertical supports 4 of generally equal length have attached to their lower ends 8 a pair of outwardly and downwardly extending legs 6. The legs are also of generally equal length and are parallel. The distance between the legs, and likewise between the body members, is slightly larger than the thickness of a standard joist, typically about $1\frac{3}{4}$ inch. The joist support stirrup provides the bearing surface upon which the edge of the joist will rest. Although in the preferred embodiment the stirrup has the same round cross sectional shape as the rest of the joist hanger aid, if desired the upper surface of the stirrup could be altered to provide a larger bearing area for the joist.

Arms 12 extend horizontally from the upper ends of the supports. The arms typically rest upon the upper surface A of beam B when mounted to the beam. The outer portion of each arm is bent into a recurved, generally U-shaped configuration so that the free ends 18 oppose the vertical body members. The distance between the free ends and the respective vertical supports is such that when the joist hanger aid is mounted over the top edge of the beam, the beam is snugly captured between the free ends of the arms and the body members of the joist hanger aid. This distance is typically slightly less than the thickness of the beam, although the actual distance will depend upon such factors as the stiffness of the resilient wire, the variation in beam widths, the configuration of the recurved portion, and the ease of removal desired. The resilient, relatively stiff material from which the joist hanger aid is formed makes the outer portion of each arm act as a spring, thereby biasing the free ends against the surface of the beam. Steel wire approximately 3/16th inch in diameter has been found suitable for producing the joist hanger aid. If desired, other materials can could be used and the shape of the arm can be altered so long as the horizontal arms are provided with a biasing portion which captures the beam between a portion of the arms and the vertical supports.

The device is simple to use. Typically, the user urges the hanger aid over the top edge of a beam so that the beam is resiliently captured between the free ends of the arms and the supports. An end of the joist is placed between the vertical supports and also between the legs until the lower surface D of the joist rests upon the stirrup. The end of the joist is thus supported by the hanger aid. After the other end of the joist has been nailed into place, the user can remove the hanger aid. This is typically accomplished by first lifting the supported end of the joist slightly to allow the free ends to slip up past the top edge of the beam. The arms are then swung over the top surface of the beam and past the sides of the joist to complete the removal. The previously supported end of the joist may then be realigned with the beam and nailed into place.

Figure 2:
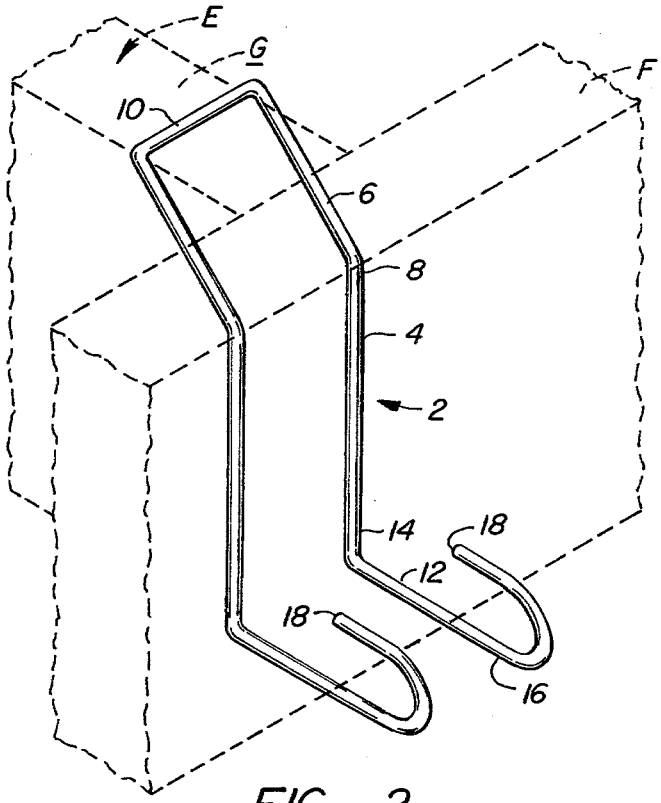
FIG. 2 is a perspective view of the preferred embodiment shown supporting a facing board adjacent to the end of a joist.

The joist hanger aid can also be used to support a facing board F against the end of a joist E as shown in FIG. 2. It should be noticed that FIG. 2 shows the joist hanger aid in an attitude which is upside down from that shown in FIG. 1. In this case, however, the horizontal arms capture and support the facing board between their free ends and their respective vertical supports; the hanger aid and facing board therewith are supported by stirrup 10 seated on the top surface G of joist E.

Although the best mode contemplated for carrying out the present invention has been herein shown and described, it will be apparent that modification and variation may be made without departing from what is regarded to be the subject of the invention.

What is claimed is:

1. In a joist hanger aid of the type having a pair of vertical support members, outwardly extending joist support means attached to the lower ends of said support members, a pair of horizontally extending arm members extending respectively from the upper ends of said support members, said arms being adapted to hook over the upper surface of a beam, the improvement comprising:

means for resiliently capturing said beam between a portion of at least one of said arm members and said respective support member, said capturing means including a relatively stiff, resilient wire member extending from at least one said arm member in a recurved fashion, the outer free end of said wire member being in opposed spaced relation with said vertical support member, the distance between said free end and said vertical support member being sufficient to securely capture said beam between said free end and said vertical support member, said wire member being capable of allowing said distance to be greater than the width of said beam thereby allowing said hanger aid to be removed from said beam and allowing the hanger aid to be reused.

2. The improved joist hanger aid of claim 1 wherein: there is one said wire member extending from each of said arm members.

3. The improved joist hanger aid of claim 1 wherein: said distance between said free end and said body member is less than the thickness of said beam.

4. The improved joist hanger aid of claim 1 wherein: said distance is substantially equal to the width of said beam.

5. A joist hanger aid for securing one end of a joist to a beam comprising:

means for engaging the top surface of said beam;

means for supporting the lower surface of one end of said joist;

means for connecting said engaging means and said supporting means; and said engaging means having means for resiliently capturing said beam between said resilient capturing means and said connecting means, said resilient capturing means including a resilient recurved extension means having a free end in spaced opposed relation to said supporting means, whereby said capturing means biases said free end against said beam thereby capturing said beam between said free end and said supporting means thereby insuring that said joist hanger aid remains fixed to said beam.

6. A removable, reusable joist hanger aid comprising:

a pair of spaced apart parallel vertically extending support members having first and second ends;

a pair of generally parallel legs, each of said legs attached to and obliquely extending from a respective second end of said support members;

a stirrup member attached to and connecting the outer ends of said legs;

a pair of generally parallel, horizontally extending arms, each of said arms attached to and extending from a respective first end, said arms extending away from said support member; and said arms having means for resiliently securing a board against said support members, said means being in spaced apart relation and including a pair of generally U-shaped extensions of said arms, the free ends of said arms in spaced opposed relation to their respective body members.

7. The joist hanger aid of claim 6 wherein:

said arms are relatively stiff, resilient wire;

the distance between said legs is sized for insertion of a board therebetween; and the distance between the free ends of said arms and said support members is sized for snug placement of a board therebetween, thereby insuring said hanger aid remains fixed to said board.

8. The joist hanger aid of claim 7 wherein said distance between the free ends and the support members is no greater than the width of the board.

* * * * *